United States Patent [19]

Thettu

[11] 3,970,038

[45] July 20, 1976

[54] ROLL FUSER

[75] Inventor: Raghulinga R. Thettu, Webster, N.Y.

[73] Assignee: Xerox Corporation, Stamford, Conn.

[22] Filed: Jan. 2, 1975

[21] Appl. No.: 537,991

[52] U.S. Cl. ..... 118/60; 118/104; 118/203; 432/75

[51] Int. Cl.[2] ..... G03G 15/20

[58] Field of Search ..... 118/70, 60, 104, 203; 432/60, 75, 228; 427/22; 355/15; 29/132; 101/425

[56] References Cited

UNITED STATES PATENTS

| | | | |
|---|---|---|---|
| 3,649,992 | 3/1972 | Thettu | 118/60 |
| 3,718,116 | 2/1973 | Thettu | 118/60 |
| 3,795,033 | 3/1974 | Donnelly et al. | 29/132 |
| 3,796,183 | 3/1974 | Thettu | 118/104 |
| 3,811,821 | 5/1974 | Ariyama et al. | 432/228 |
| 3,878,818 | 4/1975 | Thettu et al. | 118/104 |

*Primary Examiner*—Louis K. Rimrodt
*Assistant Examiner*—Douglas Salser

[57] ABSTRACT

Fuser apparatus for fixing toner images to substrates comprising a heated fuser roll structure and a backup roll structure forming a nip through which the substrates pass with the toner images contacting the heated fuser roll structure to thereby soften the toner images. A cleaning structure for removing toner offset to said fuser roll structure comprises a plurality of flexible fingers supported for wiping contact with the fuser roll structure. Spaces between the finger serve as areas for collecting the toner to prevent the toner from re-applied to the fuser roll. The cleaning structure contacts areas of the fuser roll prior to such areas being contacted by a wick employed for applying offset preventing liquid to the fuser roll, such positioning of the fuser roll structure serving to prolong the life of the wick.

10 Claims, 1 Drawing Figure

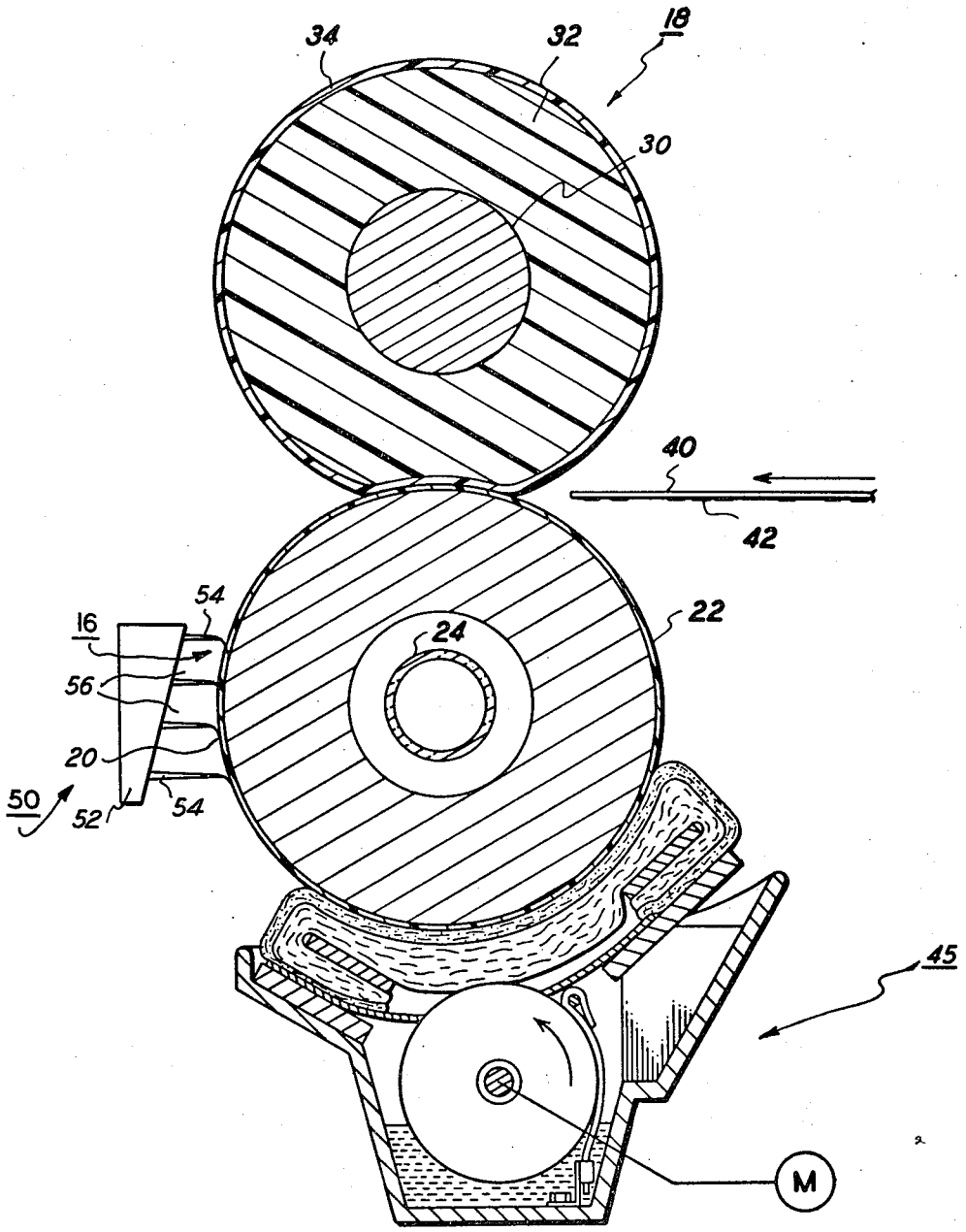
34
32
18
30
40
42
54
16
24
22
56
20
50
52
54
45
M

ROLL FUSER

BACKGROUND OF THE INVENTION

This invention relates generally to xerographic copying apparatus and, more particularly, to a contact fusing system and cleaning mechanism therefor for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to thereby result in "hot offset." Splitting occurs when the cohesive forces holding the viscous toner mass together are less than the adhesive forces tending to offset it to a contacting surface such as a fuser roll.

However, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface. The foregoing notwithstanding, "non-visual offsetting" (i.e. offsetting of very fine particles of toner) does occur. In prior art constructions (fuser structures where the outer surface comprises Teflon or silicone rubber) such offsetting has been combated by the employment of various cleaning members, the wick material employed for applying the silicone based oil to the fuser roll serving this purpose.

It will be appreciated by those skilled in the art that it is not desirable to contaminate the wick in this manner since it greatly shortens the life expectancy thereof.

Accordingly, the primary object of this invention is to provide a new and improved contact fuser system for fixing toner images to substrates.

A more particular object of this invention is to provide a fuser roll cleaning structure for utilization with contact fuser members.

Another object of this invention is to provide a contact fuser system employing a fuser roll structure wherein a cleaning member for said fuser roll structure comprises a plurality of wiper fingers which remove offset toner from the fuser roll structure to thereby enhance the life of a wick arrangement for applying offset preventing liquid to the fuser roll structure.

BRIEF SUMMARY OF THE INVENTION

Briefly, the above-cited objects are accomplished by the provision, in a xerographic copier or reproduction apparatus, a contact fuser comprising a heated fuser roll structure and a backup roll structure forming a nip therebetween through which substrates carrying toner images pass with the toner images contacting the heated fuser member to thereby become softened. Subsequent cooling of the toner renders the images permanently fixed to the substrates.

With the foregoing arrangement toner particles are offset to the heated fuser roll and to a lesser degree to the backup roll. In order to obviate the adverse effects of such offsetting, a cleaning member for removing the offset toner is provided which is supported in wiping contact with the fuser roll. The cleaning member comprises a plurality of flexible fingers which are disposed intermediate the aforementioned nip and a wick member which applies offset preventing liquid to the fuser roll structure. The movement of the fuser roll structure is in a direction such that after portions thereof pass through the nip they are contacted first by the cleaning fingers and then by the wick applicator. The foregoing arrangement of the fingers and wick serves to protect the wick from contamination by the toner.

DESCRIPTION OF THE DRAWING

The FIGURE is a side elevational view of a contact fuser representing the invention.

DETAILED DESCRIPTION OF THE PREFERRED EMBODIMENT

Since the xerographic reproducing process is well known, a detailed description thereof is omitted. For those who would consider a description of the xerographic process necessary for a complete understanding of the present invention reference may be had to U.S. Pat. Nos. 3,718,116 and 3,745,972.

As shown in the FIGURE, the present invention comprises a fuser assembly including a heated fuser roll structure 16 and a backup roll structure 18. The fuser roll structure 16 is a hollow circular cylinder with a metallic core 20 and a Teflon layer 22. A quartz lamp 24 serves as a source of thermal energy and is located internally of the fuser roll structure. Power to the lamp can be controlled by a thermal sensor generally called a thermistor contacting the periphery of the fuser roll structure as described, for example, in U.S. Pat. No. 3,357,249. The backup roll structure is also a circular cylinder and is fabricated of a metal core 30 surrounded by a thick rubber layer 32 and also has a Teflon layer 34 to prevent soaking silicone oil into the rubber layer 32 with subsequent swelling thereof.

When the two roll structures 16 and 18 are engaged, as shown in the FIGURE, the applied load deforms the rubber in the backup roll to provide a nip with a finite width. Copy sheets or substrates 40 bearing toner images 42 electrostatically adhered thereto are moved through the nip with the toner images contacting the fuser roll structures 16. For a given temperature of the fuser roll structure, the fusing rate will depend upon the contact arc length of the support material and the dwell time, i.e., the time the toner images remain between the fuser roll structure 16 and the backup roll structure 18. Dwell time can be varied either by changing the surface velocity of the rolls or by varying the contact arc length and holding the speed of the roll constant. Contact arc length depends on the softness of the rubber on the backup roll 18 and on the amount of pressure between the rolls 16 and 18. The mechanism for driving the rolls and for lowering and raising the rolls into contact may be provided by any suitable means as that described, for example, in U.S. Pat. No. 3,291,466.

As a sheet of material 40 is advanced between the rolls 16 and 18, the toner images on the support material will contact the heated outer surface of the roll 16 whereby the toner images become tackified and in this condition the toner will tend to offset to the fuser roll except that it is partially prevented from doing so by the Teflon coating or layer 22 and a thin film of silicone oil applied to the Teflon layer.

An oil dispensing mechanism including a wick assembly 40 is generally indicated by reference character 45. The purpose of the dispensing mechanism is to apply the aforementioned thin film of silicone oil to the fuser roll surface. For a detailed discussion of the oil dispensing mechanism, reference may be had to U.S. Pat. No. 3,745,972 incorporated herein by reference.

In order to remove toner particles offset to the fuser roll, a cleaning structure 50 is provided. The structure 50 comprises a base 52 which is stationarily mounted relative to the fuser roll structure such that a plurality of flexible fingers 54 carried thereby, are supported in wiping contact with the fuser roll. A plurality of spaces 56 are formed between the fingers. The toner removed from the fuser roll accumulates in these recesses. Typical plastic materials are polyimide films, high temperature nylons, high temperature polyesters and fluoroelastomers. The flexible fingers may be fabricated from various metals, plastics and elastomeric materials such as steel reinforced "Grafoil" and silicone rubber.

As can be noted from the FIGURE, the cleaning structure 50 is disposed intermediate the aforementioned nip and the wick assembly 40 whereby toner offset to the fuser roll structure is removed therefrom prior to the application of the silicone oil by the wick 40.

While the invention has been shown and described in conjunction with the preferred embodiment thereof, it will be understood that various modifications thereto may be made by those skilled in the art without departing from the spirit of the invention. Accordingly, it is intended that such modifications be covered by the claims appended thereto.

What is claimed is:

1. In a contact fuser for fixing toner images to substrates, in combination:

a heated fuser member;

a backup member cooperating with said heated fuser member to form a nip through which said substrates pass to thereby soften toner images;

wick means for applying offset preventing liquid to said heated fuser member; and cleaning means contacting one of said members for removing toner offset thereto, said cleaning means being disclosed intermediate said nip and said wick such that toner offset to said fuser member is removed therefrom prior to offset preventing liquid being applied to said fuser member, said cleaning means comprising a plurality of spaced-apart fingers supported in wiping contact with said fuser member and having spaces therebetween for accumulating toner removed from said heated member.

2. Apparatus according to claim 1, wherein said members comprise roll structures.

3. Apparatus according to claim 2, wherein said fuser roll structure comprises an outer surface of polytetrafluoroethylene.

4. Apparatus according to claim 3, wherein said fuser roll structure is internally heated.

5. Apparatus according to claim 1, wherein the cleaning fingers comprise polyimide plastic.

6. Apparatus according to claim 1, wherein the cleaning fingers comprise steel reinforced Grafoil.

7. Apparatus according to claim 1, wherein the cleaning fingers comprise high temperature nylon.

8. Apparatus according to claim 1, wherein the cleaning fingers comprise high temperature polyester material.

9. Apparatus according to claim 1, wherein the cleaning fingers comprise fluoroelastomeric material.

10. Apparatus according to claim 1, wherein the cleaning fingers comprise silicone material.

* * * * *